US007635286B1

(12) United States Patent
Morello

(10) Patent No.: US 7,635,286 B1
(45) Date of Patent: Dec. 22, 2009

(54) ELECTRICAL CONNECTOR

(75) Inventor: John R. Morello, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/287,873

(22) Filed: Oct. 14, 2008

(51) Int. Cl.
*H01R 13/11* (2006.01)

(52) U.S. Cl. ..... 439/752.5

(58) Field of Classification Search ..... 439/752.5, 439/752, 595
See application file for complete search history.

(56) References Cited

U.S. PATENT DOCUMENTS 3,178,673 A 4/1965 Krehbiel
4,844,582 A 7/1989 Giannini
5,980,318 A * 11/1999 Morello et al. ..... 439/595
6,322,401 B2 * 11/2001 Suzuki ..... 439/751
7,048,584 B1 5/2006 Morello et al.
7,179,136 B1 2/2007 Morello
7,334,321 B2 2/2008 Gourash et al.
7,371,132 B2 * 5/2008 Tanaka ..... 439/752.5
7,384,309 B1 6/2008 Morello et al.
7,396,255 B2 7/2008 Morello et al.
2002/0076996 A1 * 6/2002 Murakami et al. ..... 439/752.5
2003/0171040 A1 * 9/2003 Lei et al. ..... 439/752.5
2006/0292935 A1 * 12/2006 Ma ..... 439/752.5

* cited by examiner

*Primary Examiner*—Gary F. Paumen
(74) *Attorney, Agent, or Firm*—Thomas N. Twomey

(57) ABSTRACT

An electrical connector has a connector body with a cavity for receiving a terminal with a camming wall for engaging the terminal. The terminal has a terminal end for engagement to another complementary terminal. The terminal has a can section axially spaced from the terminal end. The can section has a camming surface for engagement to the camming wall of the connection body for indexing the terminal with respect to the connector body as the terminal is axially moved into the cavity.

6 Claims, 2 Drawing Sheets

ELECTRICAL CONNECTOR

TECHNICAL FIELD

The field of this invention relates to electrical connectors and more particularly to electrical connectors having terminals that are received in cavities of connector bodies.

BACKGROUND OF THE INVENTION

Electrical connectors are often used for joining electrical circuits, wires, and electrical devices to one another or to other electrical components. In one type, a plurality of terminals is jointed to a single connector body which itself has an equal number of cavities corresponding to the number of terminals so that a single terminal can be received in a single cavity. Once received, the terminals may be secured in place, requiring a tool for removal.

Most often these terminals are not round and must be correctly oriented with the cavity commonly referred to as being indexed. In some cases, the connector terminal has two indexed positions 180° from each other to properly connect the terminals within the cavities. In the past, if the terminal was not oriented within a few degrees of one of these 180° indexed positions, the terminal would not fit within the cavity and be joined to another terminal.

What is needed is an assist feature to aid in indexing a terminal to the proper rotated orientation upon entry in the cavity so that its terminal becomes properly oriented to engage a complementary terminal. What is also needed is an assist that is capable of indexing the terminal that can be significantly out of alignment from the proper oriented position,

SUMMARY OF THE DISCLOSURE

In accordance with one aspect of the invention, an electrical connector has a connector body with a cavity for receiving a terminal. The body has a camming wall for engaging a terminal. The terminal has a terminal end for engagement to another complementary terminal. The terminal has a can section axially spaced from its terminal end. The can section has a camming surface for engagement to the camming wall of the connector body for indexing the terminal with respect to the connector body as the terminal is axially moved into the cavity.

Preferably, the camming surface includes a plurality of indexed facets inclined radially and axially outward from a first axial plane toward a second axial plane away from the terminal end. The camming wall includes two opposed walls at an opening of the cavity. The plurality of inclined facets have a first set of opposed pairs of facets that engage and cam against the two opposed walls as the terminal is axially moved into the cavity.

In an embodiment, the plurality of inclined facets include a second set of opposed pairs of facets that are approximately 90° radially spaced from the first set.

The connector has a rail and knobs that protrude into the cavity. The rail is spaced a distance axially from the camming wall to engage a tab on the terminal after the camming wall and facets index the terminal to a predetermined rotated orientation.

BRIEF DESCRIPTION OF THE DRAWINGS

Reference now is made to the accompanying drawings in which.

DETAILED DESCRIPTION OF THE PREFERRED EMBODIMENT

Figure 1:
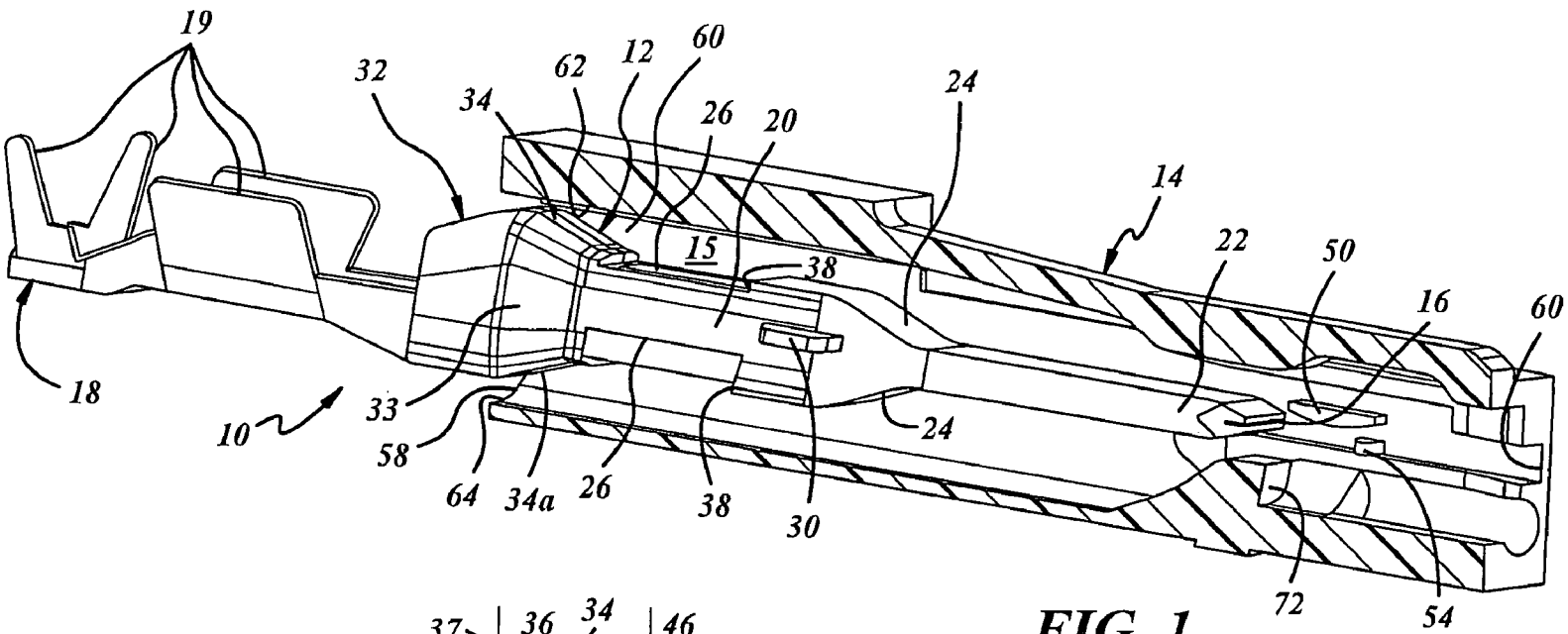
FIG. 1 is a perspective partially separated view of one embodiment of an electrical connector having a male terminal inserted in a cavity of a connector body and being indexed at a predetermined orientation but before final full engagement.
Figure 2:
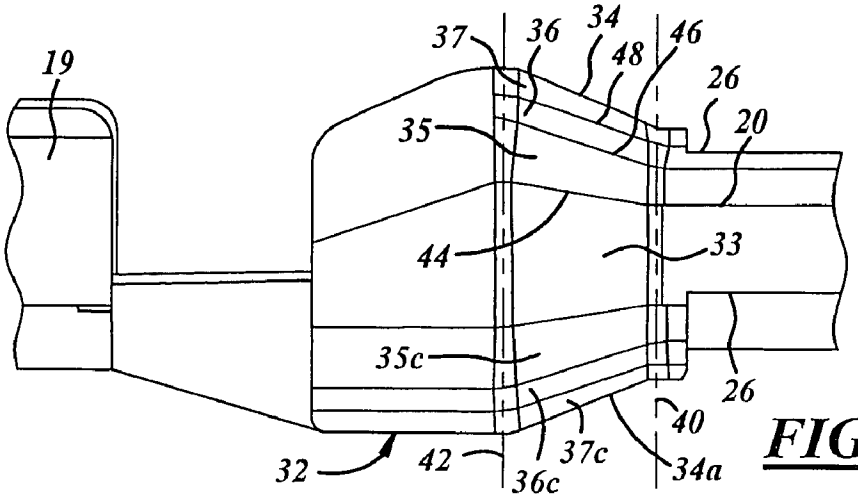
FIG. 2 is an enlarged side elevational view the electrical terminal can shown in FIG. 1.

Referring now to FIG. 1, an electrical connector 10 includes a male terminal 12 and a connector 14 with a terminal receiving cavity 15. The electrical connector 10 can mate with a complementary female terminal (not shown) at a first terminal end 16 and attaches to one or more wires (not shown) at a second end which includes crimps 19 used to secure the terminal to the wires. The crimps 19 are shown in the Figures in an unengaged, unfolded position.

The terminal 12 has a generally hollow body portion 20 with a terminal end 16 that transitions to an elongated blade section 22 that is generally rectangular in cross section. The body 20 has opposite upper and lower sloped surfaces 24, opposite side tabs 30, and upper and lower recesses 26 with planar shoulders 38. The terminal end 16 generally has a tapered blade shape. It is flattened and has a rectangular cross-section. The end 16 can engage the female terminal at two indexed positions at 180° apart. The tabs 30 and opposite slopes surfaces 24 engage the connector body 14 by a push pull movement to engage opposing rails 50 and knobs 54 and in the final position respective shoulders 38 of the terminal and 72 of connector 14 abut each other. The details of the engagement of the terminal 12 with the connector body 14 by the push pull movement is discussed in detail in U.S. Ser. No. 12/228,329 filed on Aug. 12, 2008 by the same inventor which is hereby incorporated by reference.

The terminal end 16 needs to be indexed to the proper orientation for the connection to take place. The body portion 20 has an expanding rear can section 32 that is constructed to engage the cavity to rotate the terminal at the correct indexed position if it is not already properly aligned. The terminal can section 32 has inclined facets that are constructed to rotate the terminal to the proper indexed position. Opposing facets 33 and 33*a*, and 34 and 34*a* are considered the orthogonal facets while facets 35, 35*a*, 35*b*, and 35*c*, 36*a*, 36*b*, 36*c*, 37*a*, 37*b*, and 37*c* are considered the intermediate facets. All the facets are inclined from the first axial plane 40 to a second axial plane 42. In general, the angle of inclination increases from orthogonal facets 33 and 33*a* to orthogonal facets 37 and 37*a*. The intermediate facets 35, 36 and 37 each have dividing edges 44, 46 and 48 at each side thereof to set apart the facets from each other.

Figure 3:
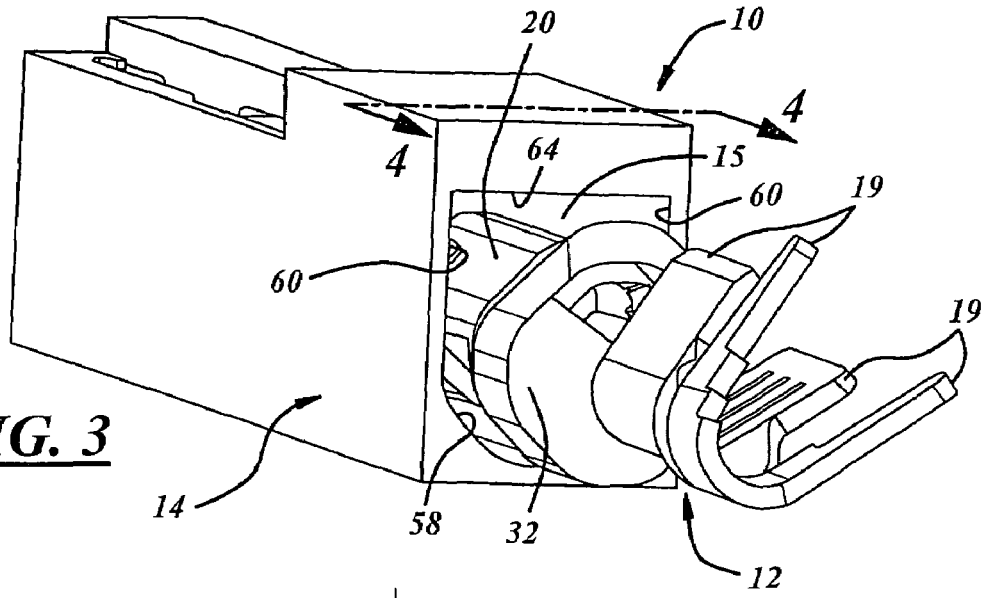
FIG. 3 is a rear perspective view of the terminal being inserted in the cavity being approximately 45° out of alignment.
Figure 4:
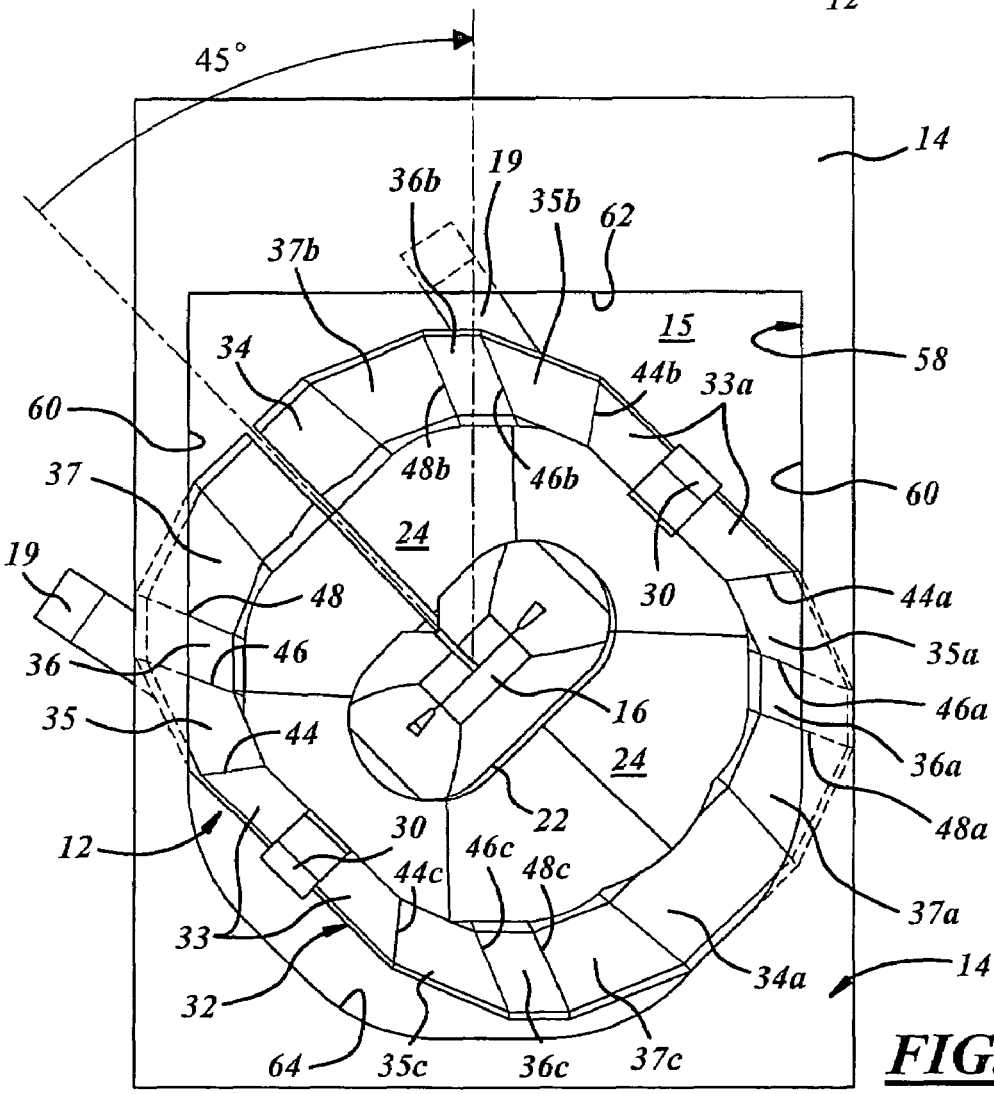
FIG. 4 is a elevational schematic view taken along lines 4-4 shown in FIG. 3.

All opposing facets 33, 33*a*, 35, 35*a*, 36, 36*a* 37, 37*a*, 34 and 34*a* are spaced apart at the axial plane 40 to fit within the two opposing side walls 60 of the cavity 15 at opening 58. Top and bottom walls 62 and 64 of the cavity 15 are set further apart such none of the facets abut walls 62 and 64. Contrarily, only opposite orthogonal facets 33 and 33*a* are spaced sufficiently close together at the second axial plane 42 to fit within the two opposing side walls 60 of cavity 15. If the terminal is rotationally positioned for example 45° as shown in FIGS. 3 and 4, the side walls 60 will abut two opposing intermediate facets for example 36 and 36*a* across the facet or at the dividing edges 44, 44*a*, 46, 46*a*, 48 or 48*a*. As the terminal is axially moved inwards into the cavity 15, the camming effect of the edges and or the facets against the opposing walls 60 will rotationally index the terminal toward an aligned position until the axial plane 42 enters opening 58 at the wall 60. This final indexed position with the crimps 19 extending upward is commonly referred to as the crimp up position. In this position, the terminal is completely rotated to an aligned indexed position with the blade section and terminal end extending horizontally within the cavity 15.

The alignment of the terminal within the cavity 15 is completed before the terminal end 16 engages a complementary terminal or the side tabs 30 engage the connect tabs 50 and connect knobs 52 within cavity 15. In this fashion, the terminal is properly oriented in its correct indexed position when the push pull connection motion is commenced to complete the connection of the terminal with the connector body.

The intermediate facets are symmetrically positioned about the orthogonal facets 32, 32*a*, 34, and 34*a* such that if the terminal is positioned 180° from the one shown in FIG. 4, the same facets will index the terminal to an appropriate crimp down position. In the crimp down position, the blade section and terminal end similarly extend horizontally within the cavity and are ready to be connected within the cavity 15 to the connector body and the female terminal.

If the terminal is oriented 90° counterclockwise or clockwise from the position shown in FIG. 4, opposing facets 35*b* and 35*c*, 36*b* and 36*c*, and edges 44*b*, 44*c*, 46*b*, 46*c*, 48*b* and 48*c* will function the same as respective facets 35 and 35*a*, and 36 and 36*a* and respective edges 44, 44*a*, 46, 46*a*, 48 and 48*a* to properly index the terminal to either the crimp down or crimp up position.

While the preferred embodiment shows the self-indexing ability will work to about a 45° rotational misalignment, it is foreseen that the facets walls 37, 37*a*, 37*b*, and 37*c* may be appropriately canted and the orthogonal walls 34 and 34*a* may be contoured to provide alignment up to a 90° misalignment. However, the modified cant of the facets and the orthogonal walls while increasing the self-indexing angle above 45° may need to have the top wall 62 and bottom wall 64 further spaced apart relative to the distance between walls 60 to accommodate the extra height involved in the terminal section 22 at axial plane 42 from the apexes of sections 34 and 34*a*.

It is further foreseen that the planar facets may be substituted with twisted facets that are curved or bent. It is further foreseen that the facets may be substituted with a continuous complex camming curved surface between the axial planes 40 and 42 thereby eliminating edges 44, 46, 48, 44*a*, 46*a*, 48*a*, 44*b*, 46*b*, 48*b*, 44*c*, 46*c* and 48*c*. These curved surfaces however may be more difficult to manufacture than the above described planar facets Though the electrical connector is described as showing a male terminal, it could instead include a female terminal with similar structure and functionality as described for the male terminal.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

The invention claimed is:

1. An electrical connector comprises:

a connector body having a cavity for receiving a terminal with a side wall of said cavity being a camming wall for engaging the terminal in proximity to an end opening of said cavity;

said terminal having a terminal end for engagement to another complementary terminal;

said terminal having a can section axially spaced from said terminal end; and said can section having a camming surface with sections inclined radially and axially outward from a first axial plane toward a second axial plane away from said terminal end at different inclinations from each other for engagement to said camming wall of said connector body for indexing said terminal with respect to said connector body as said terminal is axially moved into said cavity.

2. An electrical connector as defined in claim 1 further comprising:

said connector having a rail that protrudes into said cavity, said rail spaced a distance axially from said camming wall to engage a tab on said terminal after said camming wall and said camming surface index the terminal to a predetermined rotated orientation.

3. An electrical connector comprises:

a connector body having a cavity for receiving a terminal with a camming wall for engaging the terminal;

said terminal having a terminal end for engagement to another complementary terminal;

said terminal having a can section axially spaced from said terminal end;

said can section having a camming surface for engagement to said camming wall of said connector body for indexing said terminal with respect to said connector body as said terminal is axially moved into said cavity; and said camming surface includes a plurality of indexed facets inclined radially and axially outward from a first axial plane toward a second axial plane away from said terminal end.

4. An electrical connector as defined in claim 3 further comprising:

said camming wall including two opposed walls at an opening of said cavity; and said plurality of inclined facets having a first set of opposed pairs of facets that engage and cam against said two opposed walls as said terminal is axially moved into said cavity.

5. An electrical connector as defined in claim 4 further comprising:

said plurality of inclined facets including a second set of opposed pairs of facets that are approximately 90° radially spaced from said first set.

6. An electrical connector as defined in claim 5 further comprising:

said connector having a rail and knob that protrude into said cavity, said rail spaced a distance axially from said opposed walls to engage a tab on said terminal after said opposed walls and facets index the terminal to a predetermined rotated orientation.

* * * * *